United States Patent [19]

Matsuyoshi et al.

[11] 4,006,672

[45] Feb. 8, 1977

[54] VENTILATION FAN (VENTILATION SYSTEM)

[75] Inventors: Masaya Matsuyoshi, Nagoya; Isao Hirano, Kasugai, both of Japan

[73] Assignee: Matsushita Seiko Co., Ltd., Japan

[22] Filed: Dec. 4, 1975

[21] Appl. No.: 637,710

[30] Foreign Application Priority Data

July 31, 1975 Japan ..... 50-94047

[52] U.S. Cl. ..... 98/39; 98/116; 98/114

[51] Int. Cl.[2] ..... F24F 13/08

[58] Field of Search ..... 98/39, 43 R, 114, 116

[56] References Cited

UNITED STATES PATENTS

| | | | |
|---|---|---|---|
| 1,931,156 | 10/1933 | Persons | 98/39 |
| 2,355,836 | 8/1944 | Willey | 98/116 |
| 2,837,021 | 6/1958 | McLarty | 98/116 |
| 3,479,947 | 11/1969 | Myers | 98/116 |

FOREIGN PATENTS OR APPLICATIONS

| | | |
|---|---|---|
| 833,549 | 3/1952 | Germany |

*Primary Examiner*—William E. Wayner
*Assistant Examiner*—Henry C. Yuen
*Attorney, Agent, or Firm*—Burgess Ryan and Wayne

[57] ABSTRACT

A ventilation fan (ventilation system) which may be readily installed regardless of the length of a ventilation hole formed through the wall of a building even when the wall is of the double-wall type having an air insulating layer formed between the outer and inner wall members. The members of a duct frame are prefabricated in a factory and assembled at a job site in order to reduce the dimensions of the package, thereby reducing the packing and crating, storage and transportation costs.

2 Claims, 5 Drawing Figures

VENTILATION FAN (VENTILATION SYSTEM)

BACKGROUND OF THE INVENTION

The present invention relates to a ventilation fan system of the type in which a duct frame is fitted into a ventilation hole formed through a wall of a building from the outside thereof, a ventilation fan as well as a shutter (which is located at the leeward of the fan in case of the fan being used as an exhaust fan) are installed within the duct frame, and an exhaust fan frame with a switch adapted to be opened or closed depending upon whether the shutter is closed or opened is inserted into the duct frame.

According to the present invention, a box-shaped duct frame with an outside louver or grill attached to the outside opening of the duct frame is fitted into a ventilation hole, and a ventilation fan frame with a ventilation fan and a shutter installed therein is fitted into the duct frame from the inside of the building, the shutter being operatively interlocked with the ventilation fan and being located at the leeward side of the fan when the latter is used as an exhaust fan. Since the ventilation fan frame is so designed as to be slidably fitted into the-duct frame, the ventilation system may be readily installed regardless of the thickness of the wall or even when the wall is of a double-wall type with an air layer in such a way that the flowing of the exhausted or forced air and rain water into the air layer may be completely eliminated. Since a switch adapted to open or close depending upon whether the shutter is closed or opened is also attached to the ventilation fan frame, the relative distance between the switch and the shutter is constant regardless of the thickness of the wall so that the adjustment of the length of the pull-string of the switch may be eliminated. Since the shutter is located at the midpoint of the ventilation hole, the flapping of the shutter blades caused by the wind may be minimized as compared with the system with the shutter attached to the outside opening of the ventilation hole. When the ventilation fan is used as an exhaust fan, the shutter is located at the leeward side thereof so that the entrance of rain water into the motor of the ventilation fan may be prevented. According to the present invention, the duct frame consists of four side plates of the same dimensions and configuration assembled in the form of a box with the opened top and bottom at a job site. Therefore, the dimensions of the package of the ventilation fan system may be reduced, whereby the packing and crating, storage and transportation costs may be reduced.

In one conventional ventilation system, a duct frame with a shutter attached to the outside opening thereof is fitted from the outside of a building into a ventilation hole formed through a wall, and then a ventilation fan frame with a ventilation fan installed therein is also fitted from the outside into the duct frame. When the system is so designed that the shutter is automatically opened by the draft produced by the fan, device operated from the inside of the building for opening the shutter is not provided. But in case of the system of the type in which the fan is driven only after the shutter is wide opened, the shutter is loaded with a bias spring so that the shutter is normally opened. And the shutter is connected to a pull-string inside the building in such a way when the string is pulled-down to close the shutter and is held in pulled-down position, the string opens a switch installed inside the building and connected to the electrical circuit of the fan, whereby the fan is stopped. The distance between the shutter outside of the building and the switch inside the building cahanges depending upon the thickness of the wall so that the length of the pull-string must be adjusted from one job site to another.

In another prior art ventilation system, the ventilation fan is so arranged as to be driven when the shutter installed inside the building is opened. The distance between the shutter and the switch is, therefore, constant regardless of the wall thickness. However, when the fan is used as an exhaust fan, the rain water tends to enter into the motor of the fan because the shutter is located inwardly of the fan, thus resulting in damage to the fan motor.

In both systems described above, the length of the duct frame is made longer so that it may be installed even when the wall thickness is greater. As a result, the dimensions of the package are increased, resulting in the increase in the packing and crating, storage and transportation costs.

In a cold district, the wall of a building is, in general, of the double-wall type with an air insulating layer formed between the outer and inner walls. When the length of the duct frame is made shorter in order to reduce the dimensions of the package and when such duct frame is installed in the ventilation hole, the exhaust or forced air and rain water flow into the air layer, damaging the wall construction.

SUMMARY OF THE INVENTION

In view of the above, one of the objects of the present invention is to provide a ventilation fan which may be readily installed regardless of the wall thickness.

Another object of the present invention is to provide a ventilation fan which may eliminate the entrance of rain water into the motor thereof.

A further object of the present invention is to economize the packing and crating materials for a ventilation fan by providing a duct frame whose members are prefabricated in a factory and are assembled on a job site.

A further object of the present invention is to provide a ventilation system of the type in which a duct frame with a louver or grill attached to the outside opening thereof is fitted from the outside of a building into a ventilation hole formed through the wall, and a ventilation fan frame, in which are installed a ventilation fan and a shutter (which is located at the leeward of the fan when the fan is used as an exhaust fan), is telescopically fitted into the duct frame in such a way that the position of the fan frame may be determined depending upon the wall thickness.

A further object of the present invention is to provide a duct frame consisting of four side plates of the same configuration and dimensions prefabricated in a factory, shipped in disassembled state and assembled at a job site so that the dimensions of the package may be reduced even when the length of the duct frame is longer.

To the above and other ends, the present invention provides a ventilation fan system of the type in which a duct frame rectangular in cross section and with an outside louver or grill attached to the outside opening thereof is fitted into a ventilation hole from the outside of a building, and a ventilation fan frame, in which are installed a ventilation fan and a shutter, which is located at the leeward side of the fan when the fan is used as an exhaust fan and is operatively interlocked with the fan in such a way that the fan may driven or stopped depending upon whether the shutter is opened or closed, is telescopically fitted into the duct frame from the inside of the building and is securely held in position with screws attached through the side wall of the fan frame until the points thereof contact the inner surface of the ventilation hole or side plates of the duct frame.

DESCRIPTION OF THE PREFERRED EMBODIMENT

Figure 1:
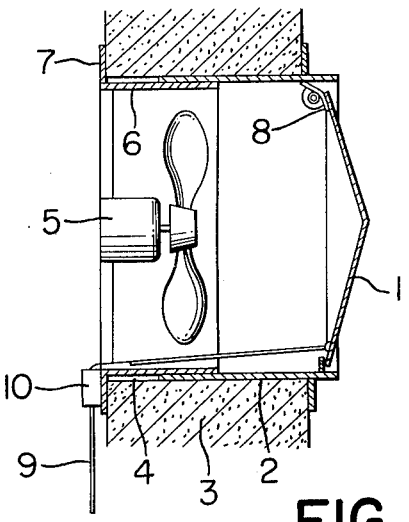
FIG. 1 PRIOR ART
FIGS. 1, 2 and 3 are schematic side views of prior art ventilation systems, the same reference numeral being used to designate similar parts throughout figures.
Figure 2:
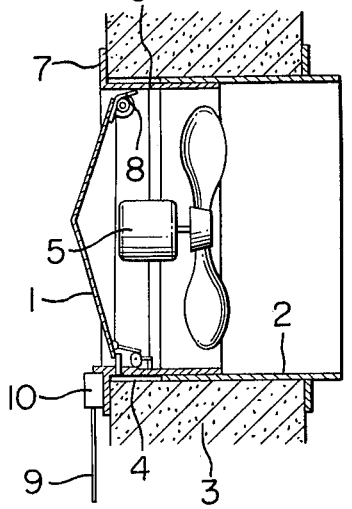
FIG. 2 PRIOR ART
Figure 3:
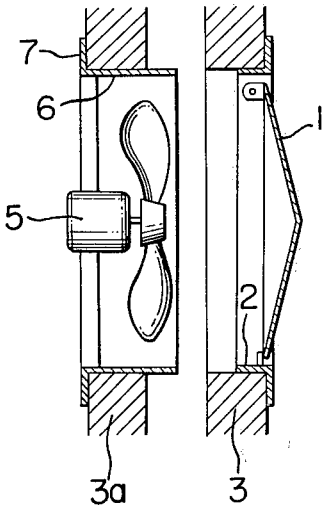
FIG. 3 PRIOR ART

Prior Art, FIGS. 1, 2 and 3

Prior to the description of the preferred embodiment of the present invention, the prior art systems will be briefly described in order to distinctly point out the problems thereof which the present invention intends to overcome. In both the description of the prior art and the present invention, the ventilation systems shall be described as being the exhaust ventilation.

In the exhaust ventilation system shown in FIG. 1, a box-shaped duct frame 2 with a shutter 1 attached to the outside opening thereof is inserted into a ventilator hole 4 formed through a wall 3, and an exhaust fan frame 6 in which is installed an exhaust fan 5 is inserted into the duct frame 2 from the inside opening thereof in such a way that the flange 7 of the exhaust fan frame 6 is firmly pressed against the wall 3. When the shutter 1 is automatically opened by the draft produced by the exhaust fan 5, a device for opening the shutter 1 from the inside is not required. But in this system, a spring 8 is loaded between the shutter 1 and the duct frame 6 so that the shutter 1 is normally opened, and there is also provided a switch 10 of the type which, when one pulls a string 9, holds the string 9 in such a way that the shutter 1 is closed while opening an electrical circuit of the fan 5. This ventilation system, therefore, has a defect that the distance from the shutter 1 to the switch 10 changes depending upon the thickness of the wall 3. As a result, the length of the string 9 must be adjusted from one installation to another.

In the exhaust ventilation system shown in FIG. 2, the shutter 1 is attached to the inside opening so that the adjustment of the length of the string 9 depending upon the thickness of the wall 3 is not required. However, since the shutter 1 is attached inwardly of the exhaust fan 5, the rain water tends to enter into the motor of the exhaust fan 5, thereby damaging it.

In both the ventilation systems shown in FIGS. 1 and 2, the length of the duct frame 2 is made longer so that the ventilation system may be installed even when the wall thicknes is great. As a result, the packing, storage and transportation costs are rather expensive.

The exhaust ventilation system shown in FIG. 3 is adapted to be installed in a building in a cold district. The wall of the building is of the double type having an air layer formed between the outside and inside wall member 3 in order to thermally insulate the building. When the length of the duct frame 2, which is fitted into the ventilation hole from the outside, is made shorter in order to reduce the dimensions of the package of the ventilation system, the exhausted air and the rain water flow into the air layer, thereby damaging the wall.

Figure 4:
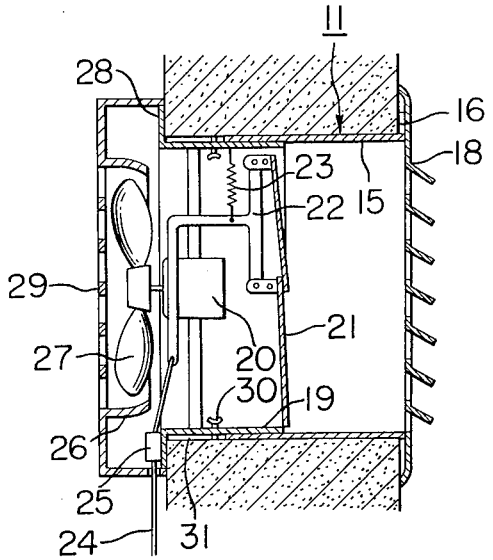
FIG. 4 is a sectional view of one preferred embodiment of a ventilation system in accordance with the present invention.
Figure 5:
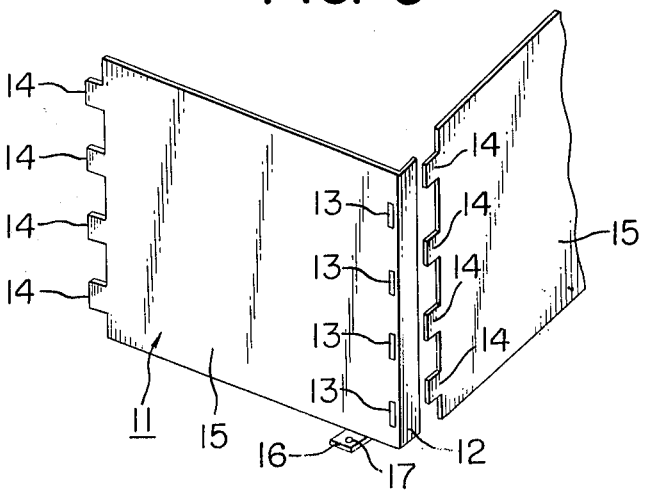
FIG. 5 is a perspective, exploded view of a duct frame thereof.

The Invention, FIGS. 4 and 5

The present invention was made to overcome the above problems of the prior art exhaust ventilation systems. In general, the exhaust ventilation system in accordance with the present invention comprises a box-shaped duct frame 11, an exhaust fan frame 19 carrying an exhaust fan 20, and an orifice or fan ring frame 26 with a fan ring encircling the blades 27 of the fan 20.

As best shown in FIG. 5, the duct frame 11 consists of four L-shaped side plates 16, each having a retaining member 12, a plurality of engaging elongated slots 13 formed through the side plate 15 along one side close to the retaining member 12 and in equidistantly spaced apart relation, a plurality of engaging projections 14 formed at the opposite side of the side plate 15 so as to mate with the engaging slots 13 of another side plate 15, and a mounting projection 16 with a screw hole 17.

The four side plates 15 are assembled at a job site in the form of a box with the engaging projections 14 inserted through the engaging slots 13 and a bent 90° over the outer surface of the adjacent side plate 15.

Within the exhaust fan frame 19 are installed the exhaust fan 20 and a shutter 21 outwardly thereof. The blades of the shutter 21 are operatively connected through a connecting lever 22 and a string to a pull-string 24 of a switch 25, and a bias spring 23 is loaded between the connecting lever 22 and the exhaust fan frame 19 so that the shutter 21 is normally closed. The switch 25 is of such a type that when one pulls down the string 24 and engages it with a stopper (not shown) to keep the shutter 21 opened, the switch 25 closes the electrical circuit of the fan 20, thereby driving it.

The orifice or fan ring frame 26 has an inside louver or grill 29 formed integral therewith.

Next the mode of installation will be described. The duct frame 11 assembled in the manner described above is inserted into a ventilation hole 31 from the outside until the mounting projections 16 (See FIG. 5) are brought into contact with the outer surface of the wall. Thereafter, the duct frame 11 is securely held in position with screws (not shown) attached the wall through the screw holes 17 of the projections 16. Next an outside louver or grill 18 is attached to the wall at the outside opening of the duct frame 11. The exhaust fan frame 19 is telescopically inserted into the ventilation hole 31 and the duct frame 11 from the inside of the building until the flange 28 contacts the inner surface of the wall. Thereafter, screws 30, which are screwed into screw holes (not shown) formed through the side plate of the exhaust fan frame 19, are tightened until the points of the screws 30 engage with the side plates 15 of the duct frame 11 or the inner surface of the ventilation hole 31, whereby the exhaust fan frame 19 is securely held in position. Next the orifice or fan ring frame 27 is detachably fitted over the flange 28 of the fan frame 19.

Next the mode of operation will be described. When one pulls the string 24 and engages it with the stopper, the shutter 21 is opened and the switch 25 is closed so that the exhaust fan 20 is driven. To stop the fan 20, one releases the string 24 from the stopper so that the shutter 21 is closed under the force of the bias spring 23 and the switch 25 is opened.

What is claimed is:

1. A ventilation fan assembly for the wall of a building comprising a duct frame rectangular in cross section, an outside louver attached to an outside opening of said duct frame, said duct frame being fitted into a ventilation hole from the outside of said building; a ventilation fan frame, connection means for telescopically fitting said fan frame into said duct frame from the outside of said building, screws in the walls of said fan frame for securing the fan frame with respect to the duct frame, an exhaust fan installed in said ventilation fan frame, a shutter in said ventilation fan frame on the leeward side of said fan, and control means operatively connected to said shutter and to said fan motor for concurrently opening said shutter and starting said fan motor and for concurrently closing said shutter and stopping said fan motor.

2. A ventilation fan as set forth in claim 1 wherein said duct frame consists of four side plates of the same configuration and dimensions to be assembled at a job site into the form of a box with an opened front and rear.

* * * * *

UNITED STATES PATENT OFFICE
CERTIFICATE OF CORRECTION

Patent No. 4,006,672 Dated February 8, 1977

Inventor(s) Masaya Matsuyoshi et al

It is certified that error appears in the above-identified patent and that said Letters Patent are hereby corrected as shown below:

Column 2, line 3: "cahanges" should be --changes--.

Column 3, line 63: "thicknes" should be --thickness--.

Column 4, line 50: After "attached" insert --to--.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*